US007909015B2

(12) United States Patent
Yang

(10) Patent No.: US 7,909,015 B2
(45) Date of Patent: Mar. 22, 2011

(54) APPARATUS AND METHOD FOR ENGINE BRAKING

(76) Inventor: Zhou Yang, Oak Ridge, NC (US)

( * ) Notice: Subject to any disclaimer, the term of this patent is extended or adjusted under 35 U.S.C. 154(b) by 63 days.

(21) Appl. No.: 12/261,031

(22) Filed: Oct. 30, 2008

(65) Prior Publication Data

US 2010/0065019 A1 Mar. 18, 2010

Related U.S. Application Data

(63) Continuation of application No. 12/228,901, filed on Aug. 18, 2008, now abandoned.

(51) Int. Cl.
*F02D 13/04* (2006.01)
*F02D 13/00* (2006.01)

(52) U.S. Cl. ..... 123/321

(58) Field of Classification Search ..... 123/321, 123/320, 319, 90.12, 90.16, 90.15
See application file for complete search history.

(56) References Cited

U.S. PATENT DOCUMENTS

| | | | | |
|---|---|---|---|---|
| 4,150,640 | A * | 4/1979 | Egan | 123/321 |
| 4,836,162 | A | 6/1989 | Melde-Tuczai | |
| 5,626,116 | A * | 5/1997 | Reedy et al. | 123/321 |
| 5,655,499 | A * | 8/1997 | Uehara et al. | 123/321 |
| 6,189,504 | B1 | 2/2001 | Israel | |
| 6,244,257 | B1 | 6/2001 | Hu | |
| 6,415,752 | B1 | 7/2002 | Janak | |
| 2002/0174849 | A1 | 11/2002 | Ruggiero | |
| 2006/0081213 | A1 | 4/2006 | Yang | |

FOREIGN PATENT DOCUMENTS

| | | |
|---|---|---|
| WO | WO 90/09514 | 8/1990 |
| WO | WO 97/06355 | 2/1997 |

OTHER PUBLICATIONS

International Search Report for PCT/US2009/069622, mailed Oct. 7, 2010, 6 pgs.
U.S. Appl. No. 12/854,716, filed Aug. 11, 2010, Yang.
U.S. Appl. No. 12/348,320, filed Jan. 5, 2009, Yang.
U.S. Appl. No. 12/348,317, filed Jan. 5, 2009, Yang.
U.S. Appl. No. 12/217,813, filed Sep. 7, 2010, Yang.

* cited by examiner

*Primary Examiner* — Mahmoud Gimie
(74) *Attorney, Agent, or Firm* — Squire, Sanders & Dempsey (US) LLP

(57) ABSTRACT

Apparatus and method are disclosed for converting an internal combustion engine from a normal engine operation (20) to an engine braking (or retarding) operation (10). The engine has an exhaust valve train containing two exhaust valves (300), a valve bridge (400) and an exhaust valve lifter (200). The apparatus has an actuation means (100) including a hydraulic system integrated into the exhaust valve train. The hydraulic system contains a braking piston (160) slidably disposed in the valve bridge between an inoperative position (0) and an operative position (1). In the inoperative position, the braking piston is retracted and the actuation means disengaged from the normal engine operation. In the operative position, the hydraulic piston is extended and the actuation means opens one of the two exhaust valves (300*a*) for the engine braking operation. The apparatus also includes engine brake reset means (150) for modifying the valve lift profile generated by the enlarged normal cam lobe (220) when the small braking cam lobes (232) and (233) are integrated into the normal exhaust cam (230). The apparatus also has a control means (50) for moving the actuation means between the inoperative position and the operative position.

20 Claims, 8 Drawing Sheets

APPARATUS AND METHOD FOR ENGINE BRAKING

CROSS-REFERENCE TO RELATED APPLICATIONS

This is a continuation of application Ser. No. 12/228,901, filed on Aug. 18, 2008, now abandoned.

BACKGROUND OF THE INVENTION

1. Field of Invention

The present invention relates generally to the braking of an internal combustion engine, specifically to engine braking apparatus and method for converting an internal combustion engine from a normal engine operation to an engine-braking operation.

2. Prior Art

It is well known in the art to employ an internal combustion engine as brake means by, in effect, converting the engine temporarily into a compressor. It is also well known that such conversion may be carried out by cutting off the fuel and opening the exhaust valve(s) at or near the end of the compression stroke of the engine piston. By allowing compressed gas (typically, air) to be released, energy absorbed by the engine to compress the gas during the compression stroke is not returned to the engine piston during the subsequent expansion or "power" stroke, but dissipated through the exhaust and radiator systems of the engine. The net result is an effective braking of the engine.

An engine brake (or engine retarder) is desirable for an internal combustion engine, particularly for a compression ignition type engine, also known as a diesel engine. Such engine offers substantially no braking when it is rotated through the drive shaft by the inertia and mass of a forward moving vehicle. As vehicle design and technology have advanced, its hauling capacity has increased, while at the same time rolling and wind resistances have decreased. Accordingly, there is a heightened braking need for a diesel-powered vehicle. While the normal drum or disc type wheel brakes of the vehicle are capable of absorbing a large amount of energy over a short period of time, their repeated use, for example, when operating in hilly terrain, could cause brake overheating and failure. The use of an engine brake will substantially reduce the use of the wheel brakes, minimize their wear, and obviate the danger of accidents resulting from brake failure.

There are different types of engine brakes. Typically, an engine braking operation is achieved by adding an auxiliary engine valve event called an engine braking event to the normal engine valve event. Depending on how the engine valve event is produced, an engine brake can be defined as:

(a) Type I engine brake—the engine braking event is produced by importing motions from a neighboring cam, which generates the so called "Jake" brake;

(b) Type II engine brake—the engine braking event is produced by altering existing cam profile, which generates a lost motion type engine brake;

(c) Type III engine brake—the engine braking event is produced by using a dedicated valve lifter for engine braking, which generates a dedicated cam (rocker) brake;

(d) Type IV engine brake—the engine braking event is produced by modifying the existing engine valve lift, which normally generates a bleeder type engine brake;

(e) Type V engine brake—the engine braking event is produced by using a dedicated valve train for engine braking, which generates a dedicated valve (the fifth valve) engine brake.

The engine brake can also be divided into two big categories, i.e., the compression release engine brake (CREB) and the bleeder type engine brake (BTEB).

Compression Release Engine Brake (CREB)

Conventional compression release engine brakes (CREB) open the exhaust valve(s) at or near the end of the compression stroke of the engine piston. They typically include hydraulic circuits for transmitting a mechanical input to the exhaust valve(s) to be opened. Such hydraulic circuits typically include a master piston that is reciprocated in a master piston bore by a mechanical input from the engine, for example, the pivoting motion of the injector rocker arm. Hydraulic fluid in the circuit transmits the master piston motion to a slave piston in the circuit, which in turn, reciprocates in a slave piston bore in response to the flow of hydraulic fluid in the circuit. The slave piston acts either directly or indirectly on the exhaust valve(s) to be opened during the engine braking operation.

An example of a prior art CREB is provided by the disclosure of Cummins, U.S. Pat. No. 3,220,392 ("the '392 patent"), which is hereby incorporated by reference. Engine braking systems based on the '392 patent have enjoyed great commercial success. However, the prior art engine braking system is a bolt-on accessory that fits above the overhead. In order to provide space for mounting the braking system, a spacer may be positioned between the cylinder head and the valve cover that is bolted to the spacer. This arrangement may add unnecessary height, weight, and costs to the engine. Many of the above-noted problems result from viewing the braking system as an accessory to the engine rather than as part of the engine itself.

As the market for compression release-type engine brakes (CREB) has developed and matured, there is a need for design systems that reduce the weight, size and cost of such retarding systems. In addition, the market for compression release engine brakes has moved from the after-market, to original equipment manufacturers. Engine manufacturers have shown an increased willingness to make design modifications to their engines that would increase the performance and reliability and broaden the operating parameters of the compression release-type engine brake.

One possible solution is to use a dedicated valve lifter for the engine braking U.S. Pat. No. 5,626,116 ("the '116 patent") discloses a dedicated engine braking system (a Type III engine brake) including a rocker arm having a plunger, or braking piston, positioned in a cylinder integrally formed in one end of the rocker arm wherein the plunger can be locked in an outer position by hydraulic pressure to permit braking system operation. A solenoid valve or control valve is also integrated into the dedicated rocker arm. A cam designed exclusively for engine braking has only the small cam lobes for engine braking Therefore, the engine braking performance can be optimized without interfering with the valve lift profile design for the normal engine operation. During the normal engine operation, the control valve sits in a dent on the rocker shaft and the engine braking rocker arm stays in a neutral position. There are one gap between the rocker arm and the cam and another gap between the rocker arm and the valve bridge.

Although the engine brake system disclosed in the '116 patent has enjoyed considerable commercial success due to its high performance and compact size, it has some drawbacks. One of the drawbacks is that the engine braking rocker arm could get away from the neutral position and contact the cam and the valve bridge during the normal engine operation. The braking piston in the rocker arm would be hammered and get loose to cause serious engine damage.

Additional disadvantages of the prior art system reside in their relative complexity and the necessity for using precision components because of the need of accurate control of the rocker arm position and the braking piston stroke. Thus the system is comparatively expensive and difficult or impossible to install on certain engines.

Another integrated engine braking system for commercial vehicles is known from U.S. Pat. No. 6,234,143 ("the '143 patent") in which an integrated rocker brake with one-valve opening for engine braking is disclosed. An engine brake actuator is disposed in the rocker arm between the pivot point and the distal end. The rocker arm and the valve bridge of the engine are so arranged that the hydraulic piston of the brake actuator is able to actuate on the inner valve near the pivot point of the rocker arm. By actuating only one of the two exhaust valves, the load from engine braking is greatly reduced.

The above integrated engine brake system, however, has the following drawbacks. First, after the braking valve is lifted by the hydraulic piston, the valve bridge is tilted and the followed normal valve actuation on both the braking valve and non-braking valve by the rocker arm is asymmetric or unbalanced. Large side load could be experienced on both valve stems or on the valve bridge guide if the bridge is guided. Second, the brake system can only fit on a particular type of engines that have the "parallel" arrangement of the rocker arm and the valve bridge.

U.S. Pat. No. 6,253,730 ("the '730 patent") discloses an integrated rocker brake with a reset valve trying to avoid the asymmetric loading on the valves or the valve bridge caused by the engine braking operation as disclosed by the '143 patent. The reset valve will reset or retract the braking piston in the rocker arm before the braking valve reaches its peak braking lift so that the braking valve will return back to its seat before the main valve lift event starts, and the rocker arm can act on the leveled valve bridge and open both the braking valve and the non-braking valve without any asymmetric loading.

However, resetting the engine brake before the peak braking valve lift is very problematic. First, the duration and magnitude of the valve lift for engine braking is very small and even smaller for resetting. Second, the resetting happens at the peak engine braking load and causes high pressure or large load on the reset valve. The timing for the resetting is critical. If the resetting happens too soon, there will be too much braking valve lift loss (lower lift and earlier closing) and lower braking performance. If the resetting happens too late, the braking valve will not be able to close before the main valve event starts and cause asymmetric loading. Therefore, this type of integrated rocker engine brake may not work well at high engine speeds when the reset duration and height is extremely small and the braking load or pressure on the reset valve is very high.

Bleeder Type Engine Brake (BTEB)

The operation of a bleeder type engine brake (BTEB) has also long been known. During bleeder type engine braking, in addition to the normal exhaust valve lift, the exhaust valve(s) may be held slightly open during a portion of the cycle (partial-cycle bleeder brake) or open continuously throughout the non-exhaust strokes (intake stroke, compression stroke, and expansion or power stroke) (full-cycle bleeder brake). The primary difference between a partial-cycle bleeder brake and a full-cycle bleeder brake is that the former does not have exhaust valve lift during most of the intake stroke.

U.S. Pat. No. 5,692,469 and U.S. Pat. No. 7,013,867 ("the '469 and '867 patents") disclose a bleeder type engine brake (BTEB) system for engines with one and two exhaust valves per cylinder. The BTEB system works with a throttling device (also known as an exhaust brake) capable of raising exhaust pressure high enough to cause each exhaust valve to float near the end of each intake stroke. In this intermediate opening or floating of the exhaust valve, it is possible to intervene with the braking device so that the exhaust valve, which is about to close after the intermediate opening, is intercepted by a control piston charged with oil pressure and prevented from closing to create a partial cycle bleeder braking event. This is a Type IV engine brake.

The BTEB system of the type described above may not be reliable because it depends on the intermediate opening or floating of the braking exhaust valve, which is inconsistent, both in timing and magnitude. As is well known in the art, exhaust valve floating is highly engine speed dependent and affected by the quality and control of the exhaust brake, and also the design of the exhaust manifold. There may be not enough or none valve floating for the actuation of the engine braking device at middle and low engine speeds when the engine brake is highly demanded since the engine is mostly driving at such speeds. It is clear from the above description that the prior-art engine brake systems have one or more of the following drawbacks:

(a) The system is difficult to stay at a neutral position and could cause engine damage;
(b) The system is difficult to manufacture and has high complexity and cost;
(c) The system is not reliable and only work at certain engine speeds; and
(d) The system has unbalanced load on engine valves.

SUMMARY OF THE INVENTION

The engine braking apparatus of the present invention addresses and overcomes the foregoing drawbacks of prior art engine braking systems.

One object of the present invention is to provide an engine braking apparatus that does not need a neutral position. It will stay at either "off" or "on" position. When the braking apparatus is at the "off" position, it will be biased to the inoperative position and disengaged from the normal engine operation.

Another object of the present invention is to provide an engine braking apparatus with fewer components, reduced complexity and manufacturing tolerance, lower cost, and increased system reliability.

Still a further object of the present invention is to provide an engine braking apparatus that is simple in construction, easy to install, reliable in operation and effective at all engine speeds.

Yet another object of the present invention is to provide an engine braking apparatus that eliminates or greatly reduces the unbalanced load on engine valves during engine braking operation.

The apparatus of the present invention converts an internal combustion engine from a normal engine operation to an engine braking operation. The engine includes an exhaust valve train that includes two exhaust valves, a valve bridge and an exhaust valve lifter for cyclically opening and closing the two exhaust valves. The apparatus has an actuation means including a hydraulic system integrated into the exhaust valve train. The hydraulic system contains a hydraulic or braking piston slidably disposed in the valve bridge between an inoperative position and an operative position. In the inoperative position, the braking piston is retracted and the actuation means disengaged from the normal engine operation. In the operative position, the braking piston is extended and the actuation means opens one of the two exhaust valves for the engine braking operation. The apparatus also has a control means for moving the actuation means between the inoperative position and the operative position to achieve the conversion between the normal engine operation and the engine braking operation.

The actuation means can also have a dedicated valve lifter. The dedicated valve lifter contains a cam with at least one small cam lobe dedicated to the engine braking operation. The dedicated valve lifter will act on the extended braking piston and open one of the two exhaust valves for the engine braking operation or other auxiliary engine valve events.

The actuation means can also have a dedicated load supporting system including a housing installed on the engine. The housing will support the extended braking piston and hold one of the two exhaust valves open for the added auxiliary valve lift during the engine braking operation.

The braking valve lifter or the braking load supporting system can also be integrated into the existing exhaust valve lifter by modifying the cam and the rocker arm. The cam will have additional small cam lobe(s) for the engine braking operation, and its existing or normal large cam lobe needs to be enlarged to accommodate the integration of the small braking cam lobe(s) so that they can be skipped during the normal engine operation. The rocker arm will have an added braking valve lash adjusting means that is integrated into the actuation means for setting a lash or gap between the actuation means and the braking exhaust valve. An engine brake reset means can be added to modify the valve lift profile produced by the enlarged normal cam lobe so that the unbalanced load on the exhaust valves due to one-valve braking can be eliminated or reduced.

The engine braking apparatus according to the embodiments of the present invention have many advantages over the prior art engine braking systems, such as better performance and reliability, fewer components, reduced complexity, and less weight and lower cost.

BRIEF DESCRIPTION OF THE DRAWINGS

These and other advantages of the present invention will become more apparent from the following description of the preferred embodiments in connection with the following figures.

DETAILED DESCRIPTION OF THE PREFERRED EMBODIMENTS

Reference will now be made in detail to presently preferred embodiments of the invention, examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
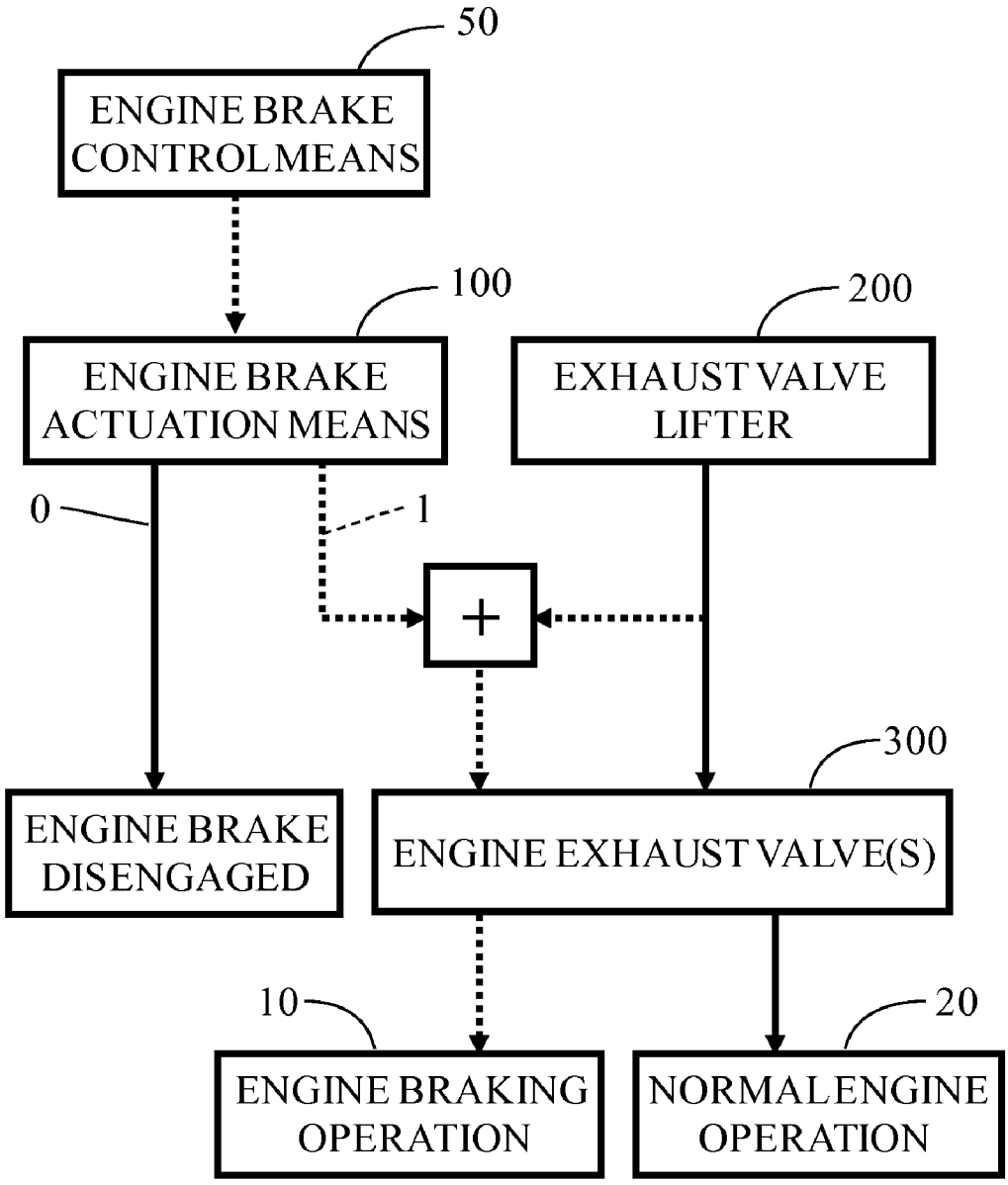
FIG. 1 is a flow chart illustrating the general relationship between a normal engine operation and an added engine braking operation according to one version of the present invention.

FIG. 1 is a flow chart illustrating the general relationship between a normal engine operation 20 and an added engine braking operation 10 according to one version of the present invention. An internal combustion engine contains two exhaust valves 300 and an exhaust valve lifter 200 for cyclically opening and closing the exhaust valve during the normal engine operation 20. The engine braking operation 10 is achieved through engine brake control means 50 and engine brake actuation means 100 that contains an inoperative position 0 and an operative position 1. To convert the engine from its normal operation 20 to the braking operation 10, the control means 50 will move the actuation means 100 from the inoperative position 0 to the operative position 1. By default, the control means 50 is at its off position, the actuation means 100 at the inoperative position 0, and the engine brake disengaged from the exhaust valves 300 and the normal engine operation 20.

Figure 2A:
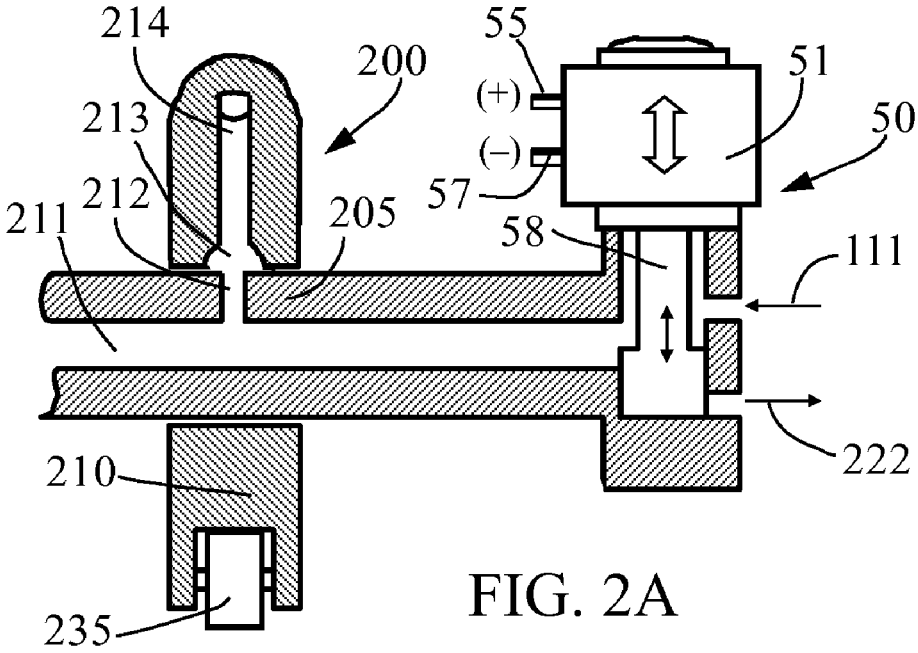
FIGS. 2A and 2B are schematic diagrams of an engine brake control mean at its "On" or "feeding" position and its "Off" or "drain" position according to one version of the present invention.
Figure 2B:
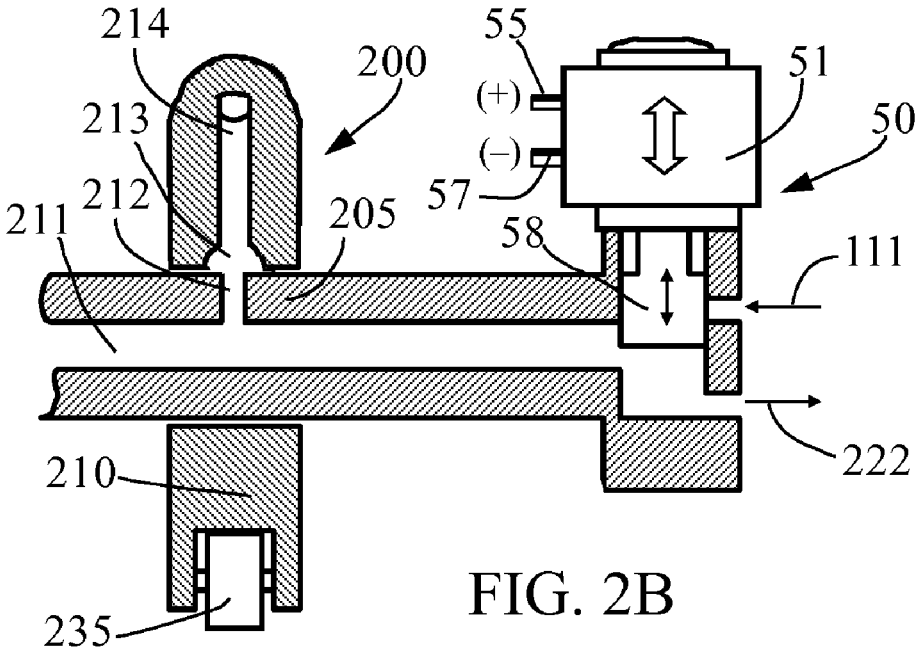

FIGS. 2A and 2B are schematic diagrams of an engine brake control means 50 at the "On" and "Off" positions. When engine braking is needed, the control means 50 containing a three-way solenoid valve 51 is turned on by electric current through the positive and negative terminals 55 and 57 as shown in FIG. 2A. The spool valve 58 is moved down and the port 111 is opened to allow engine oil to a brake fluid circuit containing a flow passage 211 in the rocker shaft 205 of the engine. The engine oil flow passes a radial orifice 212, through an undercut 213, and into a flow passage 214 in the rocker arm 210. Details of the exhaust valve lifter 200 will be shown in the following figures. When engine braking is not needed, the three-way solenoid valve 51 is turned off as shown in FIG. 2B. The port 111 is closed to stop engine oil to flow into the engine braking fluid circuit, while and at the same time, the port 222 is opened to allow engine oil to flow out of the engine braking fluid circuit. Note that the control means 50 could be remotely located and used for controlling multiple cylinder engine brakes, and the brake fluid circuit may reach other components of the engine. Also, by blocking the port 222, the three-way solenoid valve 51 is changed to a two-way solenoid valve.

Figure 3A:
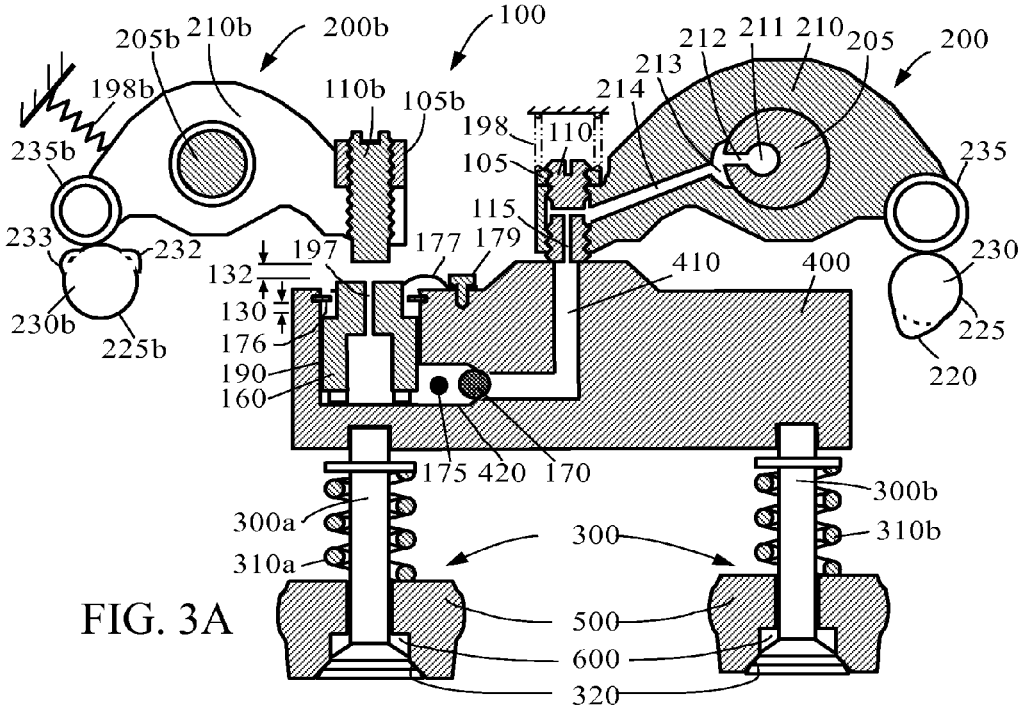
FIGS. 3A and 3B are schematic diagrams of an engine braking apparatus at the "Off" and "On" positions according to a first embodiment of the present invention.
Figure 3B:
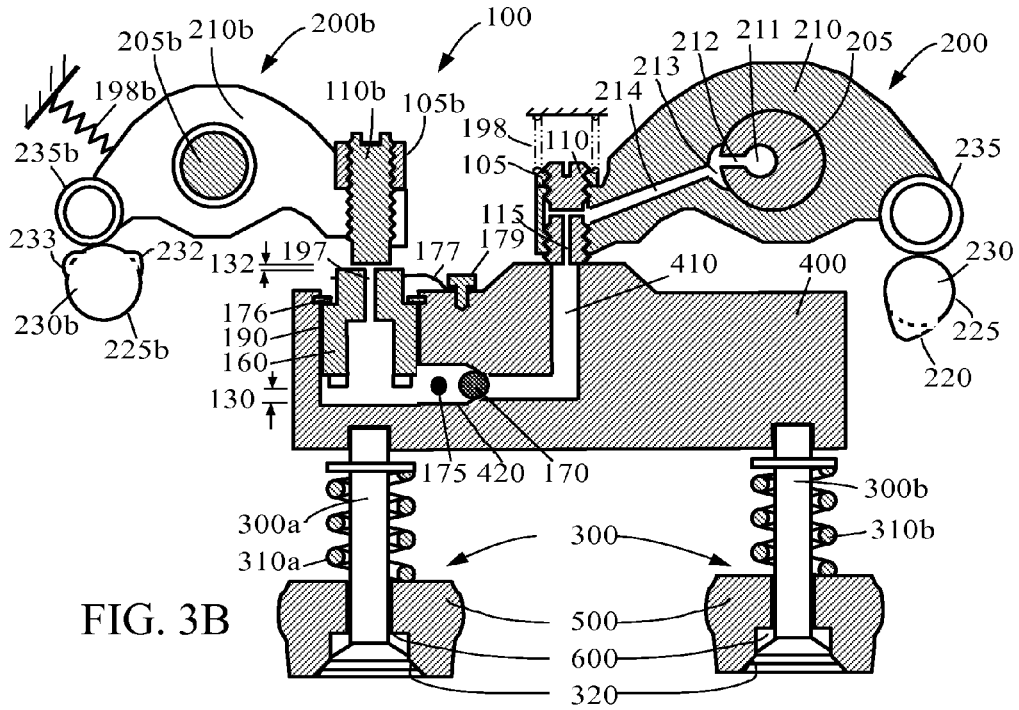

FIGS. 3A and 3B are schematic diagrams of an engine braking apparatus at the "Off" and "On" positions according to one embodiment of the present invention. There are three major sub-systems: the engine brake actuation means 100, an exhaust valve lifter 200 and two exhaust valves 300. Also, a valve bridge 400 is needed here for opening the two exhaust valves 300 with one rocker arm 210. The exhaust valve lifter 200 and the exhaust valves 300 plus the valve bridge 400 form the so called exhaust valve train. The engine brake actuation means 100 in FIGS. 3A and 3B contains a dedicated load supporting system, so that the engine braking load is not supported by the exhaust valve lifter 200. The dedicated load supporting system in this embodiment is a dedicated valve lifter 200*b* to the engine braking operation. Therefore, this is a compression release engine braking (CREB) system with a dedicated valve lifter 200*b* (a Type III engine brake).

The exhaust valve lifter 200 has components that include a cam 230, a cam follower 235, and a rocker arm 210. The exhaust cam 230 contains a large lobe 220 above the inner base circle 225 for the normal engine operation. The rocker arm 210 can pivot on the rocker shaft 205. One end of the rocker arm 210 has a cam follower 235 while the other end contains a lash adjusting screw 110 that contacts the valve bridge 400. Normally there is an elephant foot attached to the lash adjusting screw 110, but not shown here for simplicity. The lash adjusting screw 110 contains a flow passage 115 and is secured to the rocker arm 210 by a lock nut 105. A spring 198 may be used on the top of the adjusting screw 110 or other places to bias the rocker arm 210 against the valve bridge 400 for better sealing of the engine oil.

The dedicated braking valve lifter 200*b* includes a dedicated or braking cam 230*b*, a cam follower 235*b*, a rocker arm 210*b* and a braking valve lash adjusting means. The braking cam 230*b* has two small braking cam lobes 232 and 233 above the inner cam base circle 225*b* for the engine braking operation. The braking rocker arm 210*b* can pivot on the rocker shaft 205*b* and is normally biased away from the exhaust valves 300 to the inoperative position, for example, to the braking cam 230*b* by a spring 198*b*. The braking valve lash adjusting means includes a lash adjusting screw 110*b* that is secured to the rocker arm 210*b* by a lock nut 105*b*.

The two valves 300*a* and 300*b* (or simply 300) are biased upwards against their seats 320 on the engine cylinder head 500 by engine valve springs 310*a* and 310*b* (or simply 310) to seal gas (air, during engine braking) from flowing between the engine cylinder and the exhaust manifolds 600. Normally, mechanical input from the normal exhaust cam 230 is transmitted to both exhaust valves 300 through the exhaust valve lifter 200 for their cyclical opening and closing. During engine braking, additional cam motion from the two small braking cam lobes 232 and 233 (one for compression release engine braking and the other for braking gas recirculation) are transmitted through the dedicated valve lifter 200*b* to only one of the exhaust valves, for example, 300*a*. The valve lift for engine braking is about 3 millimeters or less, much smaller than the main exhaust valve lift (>10 millimeters) during the normal engine operation.

The engine brake actuation means 100 further includes a hydraulic system integrated into the exhaust valve train. The hydraulic system contains a hydraulic or braking piston 160 slidably disposed in the valve bridge 400 between the inoperative position and the operative position. Normally, the braking piston 160 is biased to the inoperative position by a spring 177 and separated from the dedicated valve lifter 200*b* by a lash 132 set by the lash adjusting means when the cam 230*b* is at its inner base circle 225*b* as shown in FIG. 3A. The lash 132 is about equal to the motion or stroke 130 of the braking piston 160. Therefore, the engine braking actuation means 100 is disengaged from the exhaust valve 300*a* and has no effect on the normal engine operation. One end of the spring 177 is on the braking piston 160 and the other end is secured on the valve bridge 400 by a screw 179. There may be other components that are not shown here for simplicity, such as an elephant foot that may be connected to the lower portion of the lash adjusting screw 110*b*. The hydraulic system further contains a flow control valve, or, one-way check valve 170 and the brake fluid circuit formed in the exhaust valve train. A bore 420 with larger diameter than the flow passage or drill 410 leads to the pressure chamber under the braking piston 160.

When engine braking is needed, the engine brake control means 50 is turned on (FIG. 2A) to allow engine oil to flow to the braking piston 160 through the brake fluid circuit that further includes the flow passage 115 in the lash adjusting screw 110 and a flow passage 410 in the valve bridge 400 as shown in FIGS. 3A and 3B. The engine oil pushes the one-way check valve 170 open against a pin 175. Oil pressure overcomes the load of spring 177 and pushes the braking piston 160 out of the bore 190 in the valve bridge 400 to the operative or extended position as shown in FIG. 3B. The braking piston 160 is stopped at the clip ring 176 with a stroke of 130, and the lash or gap 132 is taken up (totally eliminated or greatly reduced). As the braking cam 230*b* rotates, the motion from the small braking cam lobes 232 and 233 is transmitted to the exhaust valve 300*a* through the braking piston 160 and the valve bridge 400 for the engine braking operation, since the braking piston 160 is extended and hydraulically locked to the operative position by the one-way check valve 170. Also the normally opened bleeding orifice 197 in the braking piston 160 is blocked or sealed by the lash adjusting screw 110*b* (or the elephant foot) on the dedicated braking valve lifter 200*b*.

When engine braking is not needed, the engine brake control means 50 is turned off (FIG. 2B) and there will be little or no oil supplied to the brake fluid circuit. The bleeding orifice 197 will open when the braking piston 160 is pushed away from the dedicated valve lifter 200*b* by the exhaust valve lifter 200. The oil under the braking piston 160 will bleed out of the orifice 197 under the load of spring 177. The braking piston 160 will retract into the bore 190 and disengage from the dedicated braking valve lifter 200*b* as shown in FIG. 3A so that the motion of the small braking cam lobes 232 and 233 is skipped. The engine brake means 100 is now at the inoperative position and disengaged from the exhaust valve 300*a* and the normal engine operation. Therefore, the bleeding orifice 197 and the spring 177 form a flow draining means to help turning off the engine braking operation. With the flow draining means, the three-way solenoid valve 51, as shown in FIGS. 2A and 2B, may be replaced with a two-way solenoid valve.

The embodiment as shown in FIGS. 3A and 3B could be modified or varied without departing from the scope and spirit of the present invention. For instance, the cam shaft for the engine braking cam 230*b* can be a separate one or the same one as for the normal exhaust cam 230, and the rocker arm shaft for the engine braking rocker arm 210*b* can be a separate one 205*b* or the same one 205 as for the normal rocker arm 210. The spring 198 or 198*b* can also take a different type than the coil spring, for example, a flat or leaf spring, or a torsion spring. Another spring could be added to bias the one-way check valve 170 to its seat.

Figure 4A:
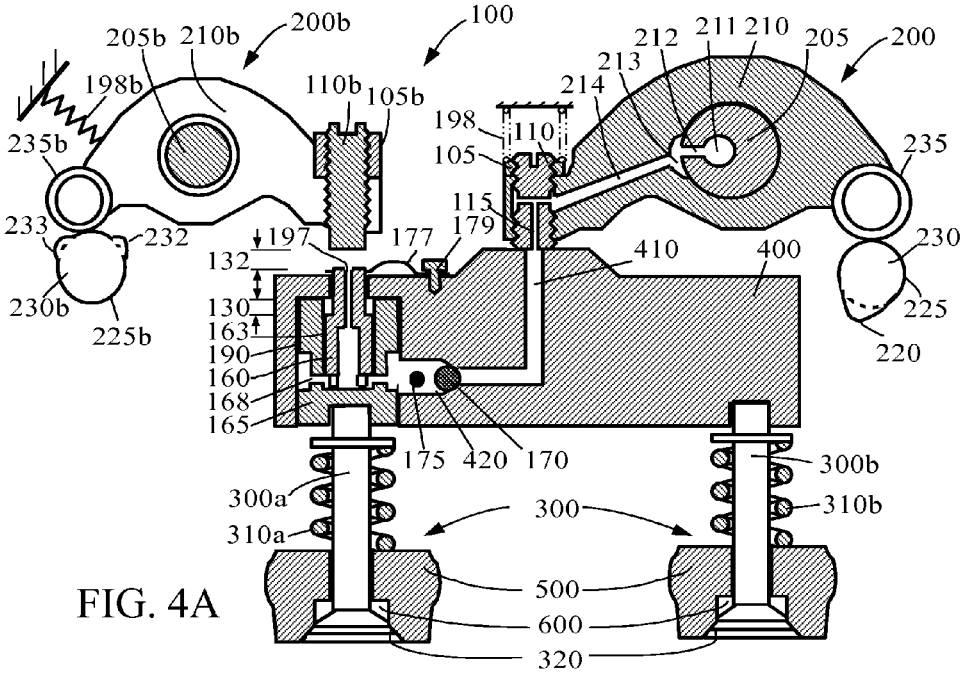
FIGS. 4A and 4B are schematic diagrams of an engine braking apparatus at the "Off" and "On" positions according to a second embodiment of the present invention.
Figure 4B:
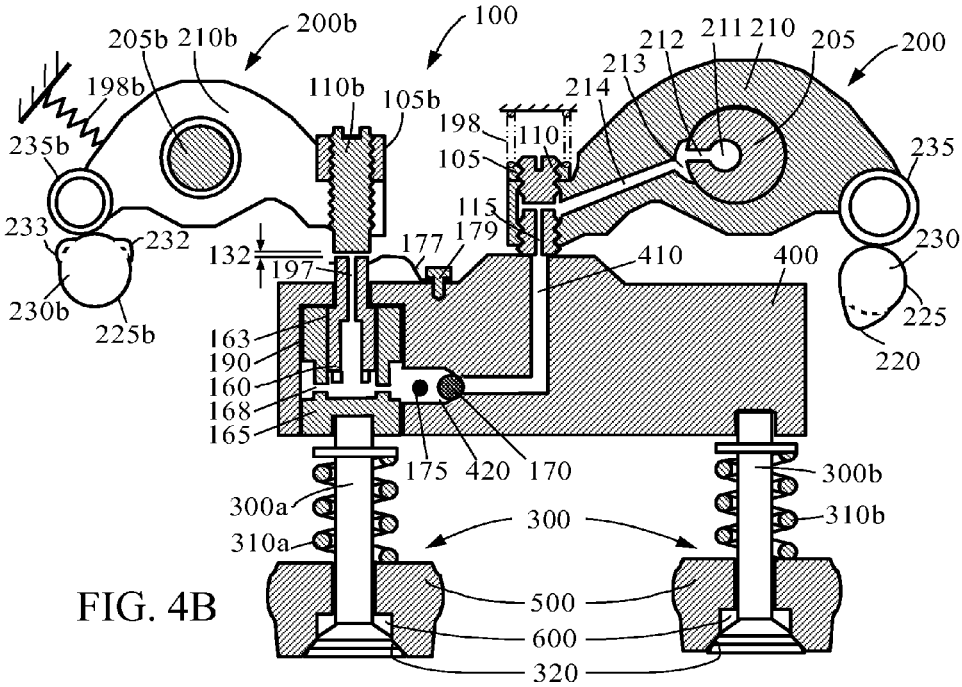

FIGS. 4A and 4B show a different version of the embodiment in FIGS. 3A and 3B with an added guide piston 165 in the valve bridge 400, while the hydraulic or braking piston 160 is now slidably disposed in a bore 163 in the guide piston 165 between an inoperative position and an operative position.

When engine braking is needed, the engine brake control means 50 is turned on (FIG. 2A) to allow engine oil to flow to the braking piston 160 through the brake fluid circuit that further includes a flow passage 168 across the guide piston 165 as shown in FIGS. 4A and 4B. The engine oil pushes the one-way check valve 170 open against a pin 175. Oil pressure overcomes the load of spring 177 and pushes the braking piston 160 out of the bore 163 in the guide piston 165 to the extended or operative position as shown in FIG. 4B. The braking piston 160 is stopped at the top of bore 190 in the valve bridge 400 with a stroke of 130, and the lash or gap 132 is taken up. As the braking cam 230*b* rotates, the motion from the small braking cam lobes 232 and 233 is transmitted to the exhaust valve 300*a* through the braking piston 160 and the guide piston 165 for the engine braking operation, since the braking piston 160 is hydraulically locked to the extended position by the one-way check valve 170 and the sealed bleeding orifice 197 by the loaded braking piston 160 and the dedicated brake valve lifter 200*b*.

During the normal engine operation or when engine braking is not needed, the engine brake control means 50 is turned off (FIG. 2B) and there will be little or no oil supplied to the engine braking fluid circuit. The bleeding orifice 197 will open when the braking piston 160 is pushed away from the dedicated valve lifter 200*b* by the exhaust valve lifter 200. The oil under the braking piston 160 will bleed out of the orifice 197 under the load of spring 177. The braking piston 160 will retract and disengage from the dedicated braking valve lifter 200*b* as shown in FIG. 4A so that the small braking cam lobes 232 and 233 are skipped. The engine brake means 100 is now at the inoperative position and disengaged from the normal engine operation.

Figure 5:
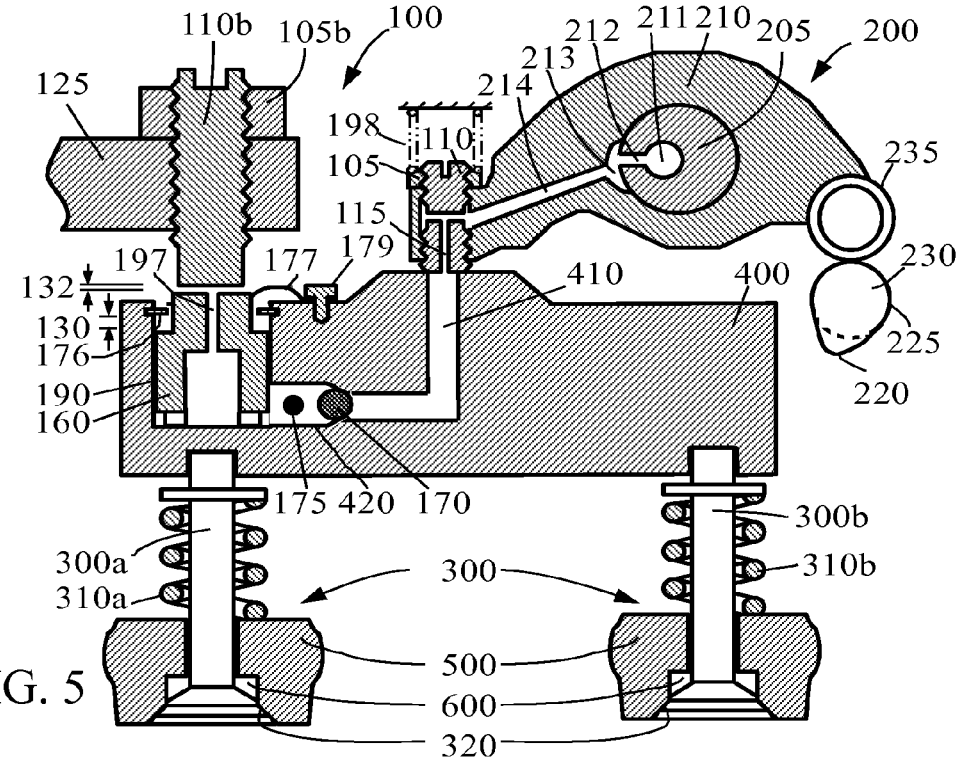
FIG. 5 is a schematic diagram of an engine braking apparatus at the "Off" position according to a third embodiment of the present invention.

FIG. 5 is a schematic diagram of an engine braking apparatus according to another embodiment of the present invention. It is similar to the embodiment shown in FIGS. 3A and 3B except that the dedicated load supporting system does not have the dedicated valve lifter 200*b* but a housing 125 fixed on the engine. The housing also includes a valve lash adjusting means containing the lash adjusting screw 110*b* secured on the housing 125 by a lock nut 105*b*. Therefore, the braking valve lift is not achieved by the actuation of the small cam lobes 232 and 233, but by preventing the exhaust valve 300*a* that is opened by the exhaust valve lifter 200 from closing or returning to its seat.

When engine braking is needed, oil is supplied to the brake fluid circuit through the control means 50 and pushing the braking piston 160 out of the bore 190 in the valve bridge 400. However, the braking piston 160 can't move to the fully extended or operative position when the exhaust valve 300*a* is seated because the piston stroke 130 is larger than the valve lash 132 set by the valve lash adjusting means. The braking piston 160 is waiting for the lift or opening of the exhaust valve 300*a*. Only after the exhaust valve 300*a* is pushed down by the exhaust valve lifter 200, the braking piston 160 can be fully extended and hydraulically locked to the operative position by the one-way check valve 170. Now the opened exhaust valve 300*a* can't return to its seat but is held open by the braking piston 160 that is also supported by the housing through the lash adjusting means. Also, the bleeding orifice 197 is blocked or sealed by the loaded braking piston 160 against the housing 125 or the lash adjusting means. The opening or lift of the braking valve 300*a* equals to the difference between the piston motion or stroke 130 and the lash 132. Therefore, this is a bleeder type engine brake (BTEB).

When engine braking is not needed, there will be little or no oil supplied to the brake fluid circuit. The oil under the braking piston 160 will bleed out of the orifice 197 under the load of spring 177 when the braking piston 160 is pushed away from the housing 125 by the exhaust valve lifter 200. The braking piston 160 will retract into the bore 190 in the valve bridge 400 and separate from the housing 125 or the lash adjusting screw 110*b*, and the exhaust valve 300*a* return to its seat 320 as shown in FIG. 5. The engine brake actuation means 100 is now at the inoperative position and disengaged from the normal engine operation.

Figure 6:
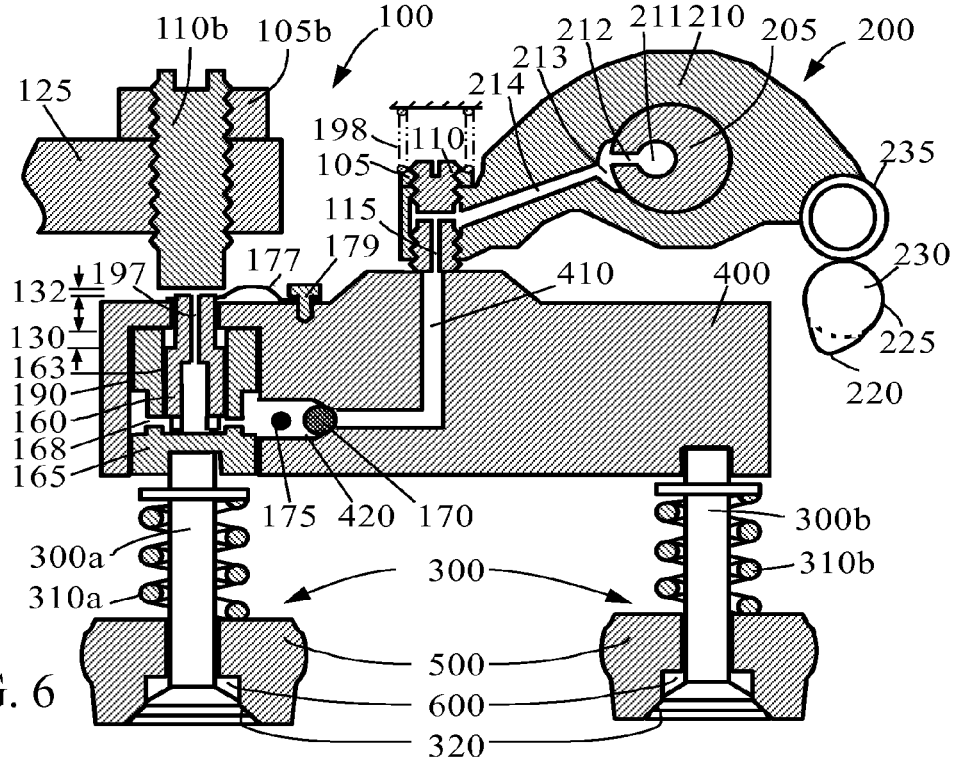
FIG. 6 is a schematic diagram of an engine braking apparatus at the "Off" position according to a fourth embodiment of the present invention.

FIG. 6 shows a new embodiment formed with the features in FIG. 5 and FIGS. 4A and 4B combined. It has the dedicated load supporting system as shown in FIG. 5 and the hydraulic system integrated into the exhaust valve train as shown in FIGS. 4A and 4B. Therefore, its working mechanism and operation are obvious and not explained here for simplicity.

Figure 7A:
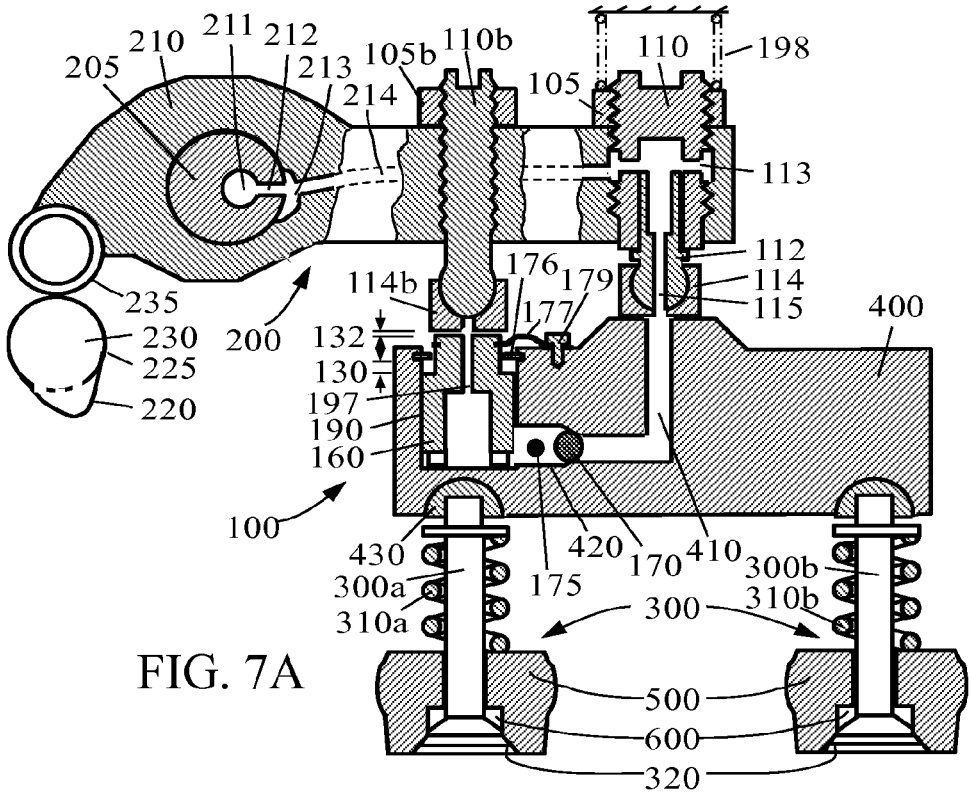
FIGS. 7A and 7B are schematic diagrams of an engine braking apparatus at the "Off" and "On" positions according to a fifth embodiment of the present invention.
Figure 7B:
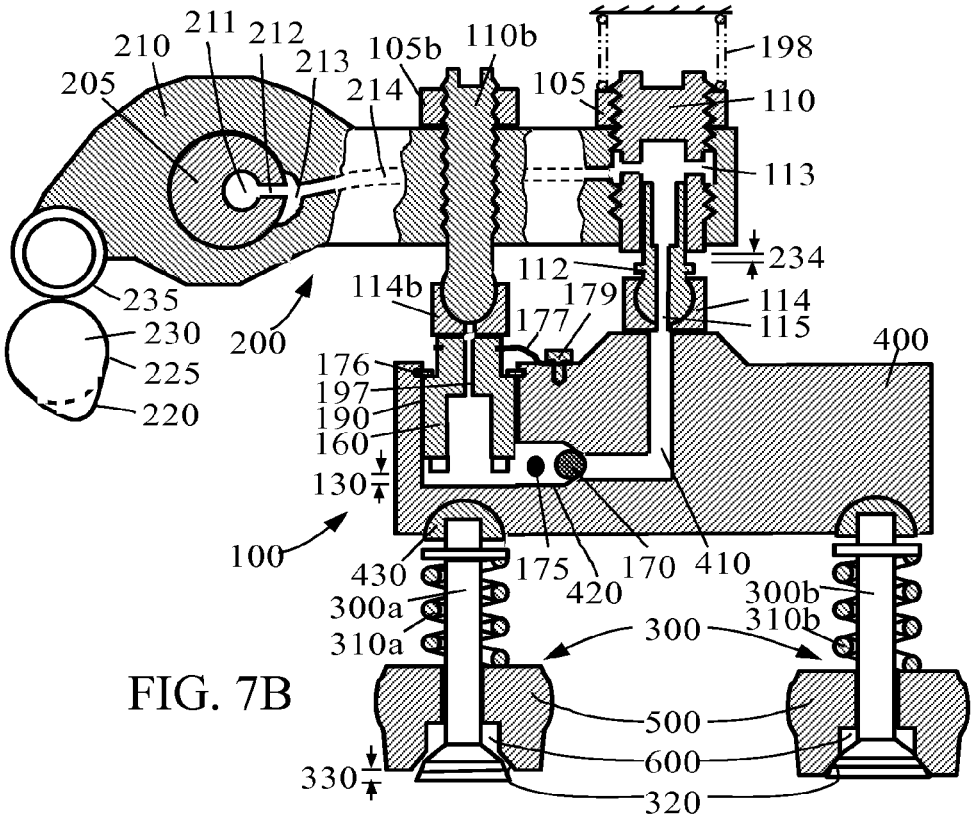

FIGS. 7A and 7B are schematic diagrams of an engine braking apparatus at the "Off" and "On" positions according to another embodiment of the present invention. Instead of using a dedicated load supporting system for the engine braking, such as the housing 125 as shown in FIGS. 5 and 6, the braking load supporting system of the engine brake actuation means 100 in FIGS. 7A and 7B is integrated into the exhaust valve lifter 200, which also acts as a braking valve lash adjusting means that contains an adjusting screw 110*b*, a lock nut 105*b* and an elephant foot 114*b*. Sliding in the regular exhaust valve lash adjusting screw 110 is a lash adjusting piston 112 attached with an elephant foot 114 for the continuous oil supply to the braking piston 160 during engine braking Also, a universal pad 430 is added between one or both valves 300 and the valve bridge 400 for an improved load transmitting during the one-valve braking At the "Off" position as shown in FIG. 7A, there is a lash or gap 132 between the braking load supporting system or the elephant foot 114*b* and the braking piston 160, which is about the same as the regular exhaust valve lash. A coil spring 198 pushes the rocker arm 210 against the valve bridge 400 for better fuel sealing that can also be achieved by putting a spring between the lash adjusting screw 110 and the lash adjusting piston 112. The lash adjusting screw 110 sits on the shoulder of the lash adjusting piston 112 during the normal engine operation. The lash 132 and the exhaust valve train are so designed that the braking load support system or the elephant foot 114*b* will not contact the braking piston 160 when it is at the retracted or inoperative position during the full cycle of engine operation. The engine brake actuation means 100 is disengaged from the exhaust valves 300 and has no effect on the normal engine operation.

When engine braking is needed, the engine brake control means 50 is turned on (FIG. 2A) to allow engine oil to flow to the braking piston 160 through the brake fluid circuit that further includes the cross drill 113 in the lash adjusting screw 110, the flow passage 115 in the lash adjusting piston 112 and a flow passage 410 in the valve bridge 400 as shown in FIGS. 7A and 7B. The engine oil pushes a flow control valve, or, a one-way check valve 170 open against a pin 175. Oil pressure overcomes the load of spring 177 and pushes the braking piston 160 out of the bore 190 in the valve bridge 400 against the braking load support system or the elephant foot 114*b* as shown in FIG. 7B. However, the braking piston 160 can't move to the fully extended or operative position when the exhaust valve 300*a* is seated because the piston stroke 130 is larger than the valve lash 132. The braking piston 160 is waiting for the lift or opening of the exhaust valve 300*a*. Only after the valve bridge 400 is pushed down by the exhaust valve lifter 200 with the normal large cam lobe 220 to create a separation between the elephant foot 114*b* and the braking piston 160, the braking piston 160 can be fully extended to a clip ring 176 and hydraulically locked to the operative position by the one-way check valve 170. Now the opened exhaust valve 300*a* can't return to its seat but is held open by the braking piston 160 that is supported by the braking load supporting system (or the braking valve lash adjusting means) integrated into the exhaust valve lifter 200. Also, the bleeding orifice 197 is blocked or sealed by the loaded braking piston 160 against the elephant foot 114*b*. The opening or lift 330 of the braking valve 300*a* equals to the difference between the piston stroke 130 and the lash 132, which is about 1 millimeter or even less.

Due to the one valve braking operation, the valve bridge 400 is tilted slightly. For 1 millimeter braking valve lift 330, there is 0.5 millimeter movement at the center of the bridge, which is the travel 234 of the lash adjusting piston 112 relative to the lash adjusting screw 110 (FIG. 7B). The universal pad 430 is added between the valve bridge 400 and one or both of the exhaust valves 300*a* and 300*b* for improving the load transmitting when the exhaust valve lifter 200 pushes the valve bridge 400 to open both of the exhaust valves 300 during the engine braking operation. When engine braking is not needed, the engine brake control means 50 is turned off (FIG. 2B) and there will be little or no oil supplied to the brake fluid circuit. The bleeding orifice 197 will open when the braking piston 160 is pushed away with the valve bridge 400 from the braking load supporting system or the elephant foot 114*b* by the normal exhaust cam lobe 220 of the exhaust valve lifter 200. The oil under the braking piston 160 will bleed out of the orifice 197 under the load of spring 177. The braking piston 160 will retract into the bore 190 and separate from the braking load supporting system, and the exhaust valve 300*a* return to its seat 320 as shown in FIG. 7A. The engine brake actuation means 100 is now at the inoperative position and disengaged from the normal engine operation.

Figure 8:
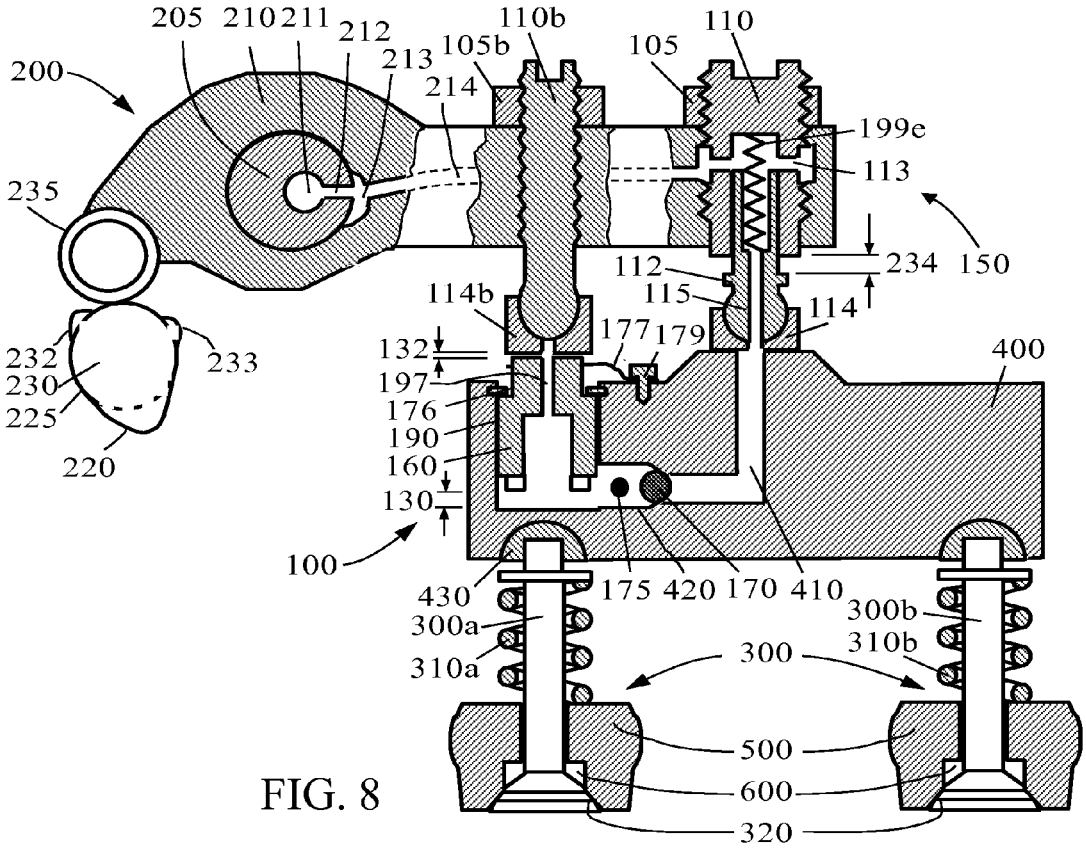
FIG. 8 is a schematic diagram of an engine braking apparatus at the "On" position according to a sixth embodiment of the present invention.

FIG. 8 is a schematic diagram of an engine braking apparatus at the "On" position according to a different embodiment of the present invention. Instead of using a dedicated valve lifter 200*b* for the engine braking operation as shown in FIGS. 3A and 3B, the braking valve lifter of the engine brake actuation means 100 in FIG. 8 is integrated into the exhaust valve lifter 200. The small braking cam lobes 232 and 233 are integrated with the existing large cam lobe 220 into the existing exhaust cam 230. The large normal cam lobe 220 needs to be enlarged even more to accommodate for the extra lift by the small cam lobes 232 and 233. A spring 199*e* is put between the lash adjusting screw 110 and the lash adjusting piston 112 to bias the rocker arm 210 against the cam 230 and to prevent no-follow of the exhaust valve train components. A different type of spring, for example, a flat spring or a torsion spring, can be used and be put at different location as long as the same purposes can be achieved. A gap 234 is designed between the lash adjusting screw 110 and the lash adjusting piston 112 so that the motion of the small braking cam lobes 232 and 233 is skipped (not transmitted to the exhaust valves 300) during the normal engine operation.

When engine braking is needed, the engine brake control means 50 is turned on (FIG. 2A) to allow engine oil to flow to the braking piston 160 in FIG. 8 through the brake fluid circuit. The engine oil pushes the one-way check valve 170 open against the pin 175 fixed on the valve bridge 400. Oil pressure overcomes the load of spring 177 and pushes the braking piston 160 out of the bore 190 in the valve bridge 400. The braking piston 160 is stopped at the clip ring 176 with a stroke of 130, and the lash or gap 132 between the elephant foot 114*b* and the braking piston 160 is taken up (totally eliminated ($\leqq 0$) or greatly reduced ($>0$)). Now the braking piston 160 is fully extended and hydraulically locked to the operative position by the one-way check valve 170. As the cam 230 rotates, the motion from the small braking cam lobes 232 and 233 is transmitted to the braking exhaust valve 300*a* through the braking valve lash adjusting means and the hydraulic linkage between the braking piston 160 and the valve bridge 400. The bleeding orifice 197 in the braking piston 160 is blocked or sealed by the elephant foot 114*b* during the engine braking actuation. Note that the motion from the small braking cam lobes 232 and 233 is not transmitted to the other (or non-braking) exhaust valve 300*b* because of the gap 234 between the lash adjusting screw 110 and the lash adjusting piston 112.

With one exhaust valve (the braking valve) 300*a* opened and the other (the non-braking valve) 300*b* closed, there is a tilt of the valve bride 400, which will create an unbalanced loading condition when the elephant foot 114 acts on the valve bridge 400 opening both of the exhaust valves 300. An engine brake reset means 150 is designed here to address the unbalanced loading issue. When the cam lift reaches certain height, the lash adjusting screw 110 will move down and touch the shoulder of the lash adjusting piston 112. The gap 234 is eliminated and the flow passage 113 in the lash adjusting screw 110 to the braking piston 160 is blocked. The fluid flow from the control means 50 to the braking piston 160 is stopped. The bleeding orifice 197 will open when the braking piston 160 is pushed away with the valve bridge 400 from the elephant foot 114*b* by the exhaust valve lifter 200 with the enlarged normal cam lobe 220. The oil under the braking piston 160 will bleed out of the orifice 197 under the load of spring 177 and the braking piston 160 will retract into the bore 190. The braking valve 300*a* will return to its seat 320 with the same closing timing as the non-braking valve 300*b*. If the braking piston 160 were still extended, the braking valve 300*a* would close much later and have a higher lift at the valve exchange top dead center, which may cause engine valve to piston contact. The higher lift and later closing valve lift without resetting are due to the enlarged cam lobe 220 with transition slopes for the small braking cam lobes 232 and 233. Once the exhaust valves 300 are seated, the rocker arm 210 continues to rotate anti-clockwise, which forms the gap 234 and opens the flow passage 113 so that oil can refill the braking piston 160. The braking piston 160 will be fully extended before the small braking cam lobes 232 and 233 start to lift the rocker arm 210 so that their motion can be transmitted to the braking valve 300*a*, and the engine braking cycle repeats. Therefore, the reset means 150 will modify the valve lift profile produced by the enlarged normal cam lobe 220, not that by the small braking cam lobes 232 and 233. The lash adjusting piston 112 is also acting as an engine brake reset piston to block the oil flow to the braking piston 160, and the bleeding orifice 197 as an engine brake reset flow passage for draining out the oil flow under the braking piston 160.

When engine braking is not needed, the engine brake control means 50 is turned off (FIG. 2B) and there will be little or no oil supplied to the brake fluid circuit. The bleeding orifice 197 will open when the braking piston 160 is separated from the elephant foot 114*b*. The oil under the braking piston 160 will bleed out of the orifice 197 under the load of spring 177. The braking piston 160 will retract into the bore 190 and not touch the elephant foot 114*b* during the whole cycle of cam rotation. The engine brake actuation means 100 is now at the inoperative position and disengaged from the engine operation.

Figure 9:
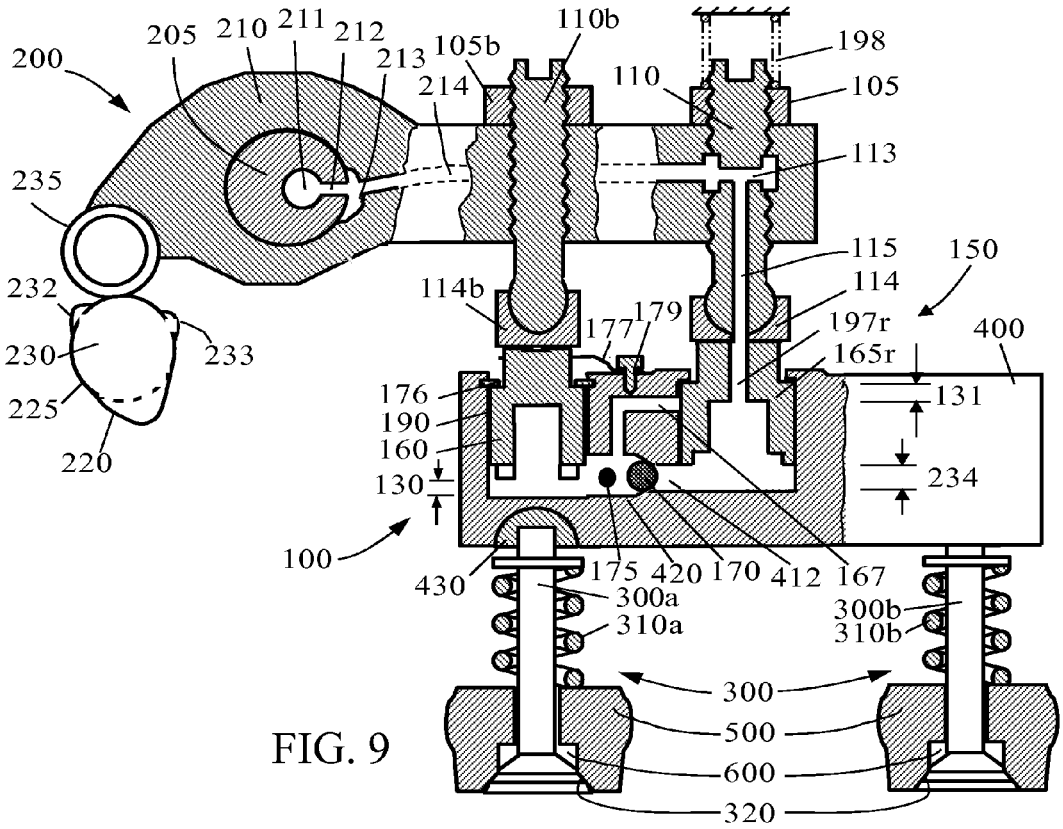
FIG. 9 is a schematic diagram of an engine braking apparatus at the "On" position according to a seventh embodiment of the present invention.

FIG. 9 shows a different version of the embodiment in FIG. 8 with a different engine brake reset means 150 that interacts with the engine brake actuation means 100 so that the valve lift profile from the enlarged normal cam lobe 220 can be modified. The reset means contains a reset piston 165*r* that is slidably disposed in the valve bridge 400 below the elephant foot 114. The reset piston 165*r* as well as the rocker arm 210 is biased to the valve bridge 400 by a spring 198 to prevent no-follow of exhaust valve train components.

When engine braking is needed, the engine brake control means 50 is turned on (FIG. 2A) to allow engine oil to flow to the reset piston 165*r* and the braking piston 160 through the brake fluid circuit that further includes the flow passage 197*r* in the reset piston 165*r*. Oil pressure overcomes the load of spring 198 as well as spring 177 and pushes the reset piston 165*r* as well as the braking piston 160 upwards to rotate the rocker arm 210 anticlockwise towards the cam 230 so that the engine braking apparatus goes to the "On" position as shown in FIG. 9. The braking piston 160 is stopped at the clip ring 176 with a stroke of 130 that takes up the lash or gap between the elephant foot 114*b* and the braking piston 160, while the reset piston 165*r* moves up with a stroke of 234 that takes up the gap existed between the cam follower 235 and the cam 230 during the normal engine operation. Now the braking piston 160 is extended and hydraulically locked to the operative position by the one-way check valve 170, and the flow draining passage or reset flow passage 167 is blocked by the reset piston 165*r*. As the cam 230 rotates, the motion from the small braking cam lobes 232 and 233 is transmitted to the braking exhaust valve 300*a* through the braking valve lash adjusting means and the hydraulic linkage between the braking piston 160 and the valve bridge 400. The motion from the small braking cam lobes 232 and 233 is not transmitted to the other exhaust valve 300*b* because of the gap 234 between the reset piston 165*r* and the valve bridge 400 as shown in FIG. 9. The oil under the reset piston 165*r* is pushed back through the flow passage 197*r*. An accumulator may be needed in the braking fluid circuit to absorb the flow pumped back by the reset piston 165*r*.

When the cam lift produced by the enlarged normal cam lobe 220 is higher than that by the small braking lobes 232 and 233, the reset piston 165*r* will touch the valve bridge 400 and act on both of the exhaust valves 300*a* and 300*b*. Before the reset piston 165*r* touches the valve bridge 400 to block the fluid flow from the control means 50 to the braking piston 160, it opens a reset flow passage 167 since the reset height 131 is smaller than the gap 234. The oil under the braking piston 160 will drain out of the passage 167 and the braking piston 160 will retract into the bore 190 under the load of spring 177. The opened exhaust valve 300*a* will return to its seat 320 and the titled valve bridge 400 will be leveled to eliminate any unbalanced load when the reset piston 165*r* acts on the valve bridge 400. Now both of the exhaust valves 300*a* and 300*b* will be opened by the enlarged cam lobe 220. Once the exhaust valves 300 are seated, the rocker arm 210 will continue to rotate anti-clockwise and the reset piston 165*r* will move up in the valve bridge 400 under oil pressure to block the reset flow passage 167 so that oil can refill and push out the braking piston 160. The braking piston 160 will be fully extended before the small braking lobes 232 and 233 start to lift the rocker arm 210 so that their motion can be transmitted to the braking valve 300*a*, and the engine braking cycle repeats.

When engine braking is not needed, the engine brake control means 50 is turned off (FIG. 2B) and there will be little or no oil supplied to the brake fluid circuit. When the reset piston 165*r* moves down and opens the reset flow passage 167, the oil under the braking piston 160 will drain out and the braking piston 160 will retract into the bore 190 under the load of spring 177. Without oil pressure, the reset piston 165*r* will be biased to the valve bridge 400 by spring 198 to form a gap between the cam follower 235 and the cam 230 to skip the motion from the small braking cam lobes 232 and 233. The two exhaust valves 300*a* and 300*b* will be opened by the top portion of the enlarged cam lobe 220 through the rocker arm 210, the reset piston 165*r* and the valve bridge 400. The retracted braking piston 160 will not touch the elephant foot 114*b* of the braking valve lash adjusting means during the whole cycle of cam rotation. The engine brake actuation means 100 is now at the inoperative position and disengaged from the normal engine operation.

With the reset means 150, the electro-hydro-mechanical system of the engine brake control means 50, as shown in FIGS. 2A and 2B, does not need to have a three-way solenoid valve 51 because the reset means 150 is also a flow draining means and will drain out the engine oil under the engine brake actuation means 100 to turn off the engine brake when is needed. Therefore there is no need for the drain port 222, and the three-way solenoid valve 51 can be replaced with a two-way solenoid valve to open and close the oil supply port 111.

Figure 10:
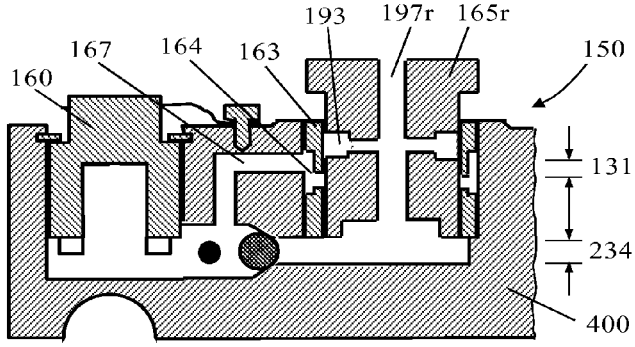
FIG. 10 is a schematic diagram of an engine braking apparatus at the "On" position according to an eighth embodiment of the present invention.

FIG. 10 shows a different version of the embodiment in FIG. 9 with a different engine brake reset means 150 to interact with the engine brake actuation means 100. A sleeve 163 with a reset flow passage 164 is inserted in the valve bridge 400. The reset flow passage 164 will communicate with the reset flow passage 193 in the reset piston 165*r* that slides in the sleeve 163. Therefore the reset flow from the braking piston 160 does not flow to the outside the valve bridge 400, but back to the braking fluid circuit. Therefore, an accumulator will be needed in the braking fluid circuit. The operation of the engine braking apparatus shown in FIG. 10 is almost the same as that shown in FIG. 9 and not explained here for simplicity.

CONCLUSION, RAMIFICATIONS, AND SCOPE

It is clear from the above description that the engine braking apparatus according to the embodiments of the present invention have one or more of the following advantages over the prior art engine braking systems.

First, the compression release engine brake (CREB) systems disclosed here have fewer components, less complexity, and lower cost. Different from the prior art engine braking system disclosed by the '116 patent, the dedicated brake rocker arm 210*b* is not at the neutral position but biased to the cam. Therefore, the systems disclosed here will not interfere with the normal engine operation.

Second, the bleeder type engine brake (BTEB) systems disclosed here have a control means 50 for active control of the engine brake actuation means 100. Different from the prior art engine braking system disclosed by the '469 and '867 patents, the actuation of the engine brake systems disclosed here does not depend on valve floating. Therefore, the BTEB systems disclosed here are more reliable, tolerant with different exhaust brakes, and effective at all engine speeds.

Third, the engine brake reset means 150 disclosed here eliminates or greatly reduces the unbalanced load on the exhaust valves 300 by the valve bridge 400. It also greatly reduces the valve overlap, the braking valve lift at the valve overlap, and the seating velocity of the non-braking exhaust valve 300*b*. Therefore, the engine braking performance is better and the potential of contact between the engine valve and piston is eliminated. In addition, the reset means 150 disclosed here is simple, accurate and reliable.

While my above description contains many specificities, these should not be construed as limitations on the scope of the invention, but rather as an exemplification of the preferred embodiments thereof. Many other variations are possible. For example, the rocker arm 210*b* biased to the cam 230*b* can be set to the inoperative position through other mechanism, such as using a spring system to hold the rocker arm 210*b* so that it separates from the cam 230*b* and the braking piston 160. Different from the prior art engine braking system disclosed by the '116 patent, the hydraulic system disclosed here is not integrated into the dedicated brake rocker arm 200*b*. Therefore, there is no such risk that the braking piston 160 would be knocked and get loose to cause engine damage.

Also, the apparatus disclosed here can be applied to a push tube type engine instead of the overhead cam type engine as shown in the figures.

Also, the apparatus disclosed here can be applied to other engine valve train with different engine valve system and engine valve lifter, such as the intake valve system and the intake valve lifter.

Also, the dedicated load supporting system installed on the engine could be different, for example, a housing fixed on the engine, or a rocker arm mounted on a rocker shaft. The system could contain a cam, for example, the braking cam 230*b* for a compression release type (Type III) engine brake, or no cam for a bleeder type (Type IV) engine brake.

Also, a poppet type solenoid valve could be used to replace the spool type valve 51 of the control means 50 as shown in FIGS. 2A and 2B.

Also, the apparatus disclosed here can be used to produce other auxiliary valve event. In general, the engine valve lift can be modified to produce an engine valve event that is different from the normal engine operation. The engine valve event could be the engine braking operation, an exhaust valve EGR event or an intake valve EGR event, etc.

Also, the two small cam lobes 232 and 233 for the engine braking operation shown in FIG. 3A and other figures could take different profiles. They could be individual ones or combined to form a single cam lobe. It could have a substantially constant lift during the engine compression stroke for a partial cycle bleeder brake. The combined single cam lobe can even be extended to be connected to the large cam lobe 220 if the small cam lobes 232 and 233 and the large cam lobe 220 are integrated into the same cam 230 as shown in FIGS. 8 and 9. Now the "single" cam lobe is in fact just a transition "step" to the large cam lobe 220. In summary, there is at least one small cam lobe and the at least one small cam lobe includes the constant lift type for a partial cycle bleeder brake.

Also, springs 177, 198, and 199*e* could have different types, for example, a coil spring, a flat spring or a torsion spring, and be put at different locations as long as the same purposes can be achieved.

Accordingly, the scope of the invention should be determined not by the embodiments illustrated, but by the appended claims and their legal equivalents.

I claim:

1. Apparatus for converting an internal combustion engine from a normal engine operation to an engine braking operation, the engine including an exhaust valve train comprising two exhaust valves, a valve bridge and an exhaust valve lifter having an exhaust cam with an exhaust cam lobe for cyclically opening and closing the two exhaust valves, said apparatus comprising:

(a) an actuator comprising a hydraulic system integrated into said exhaust valve train, said hydraulic system comprising a braking piston slidably disposed in said valve bridge between an inoperative position and an operative position; in said inoperative position, said braking piston being retracted and said actuator being disengaged from said normal engine operation, and in said operative position, said braking piston being extended and said actuator opening one of the two exhaust valves for said engine braking operation; and (b) a controller for moving said actuator between said inoperative position and said operative position.

2. The apparatus of claim 1, wherein said hydraulic system further comprises a flow control valve and a brake fluid circuit in said exhaust valve train.

3. The apparatus of claim 1, wherein said actuator further comprises a dedicated valve lifter, said dedicated valve lifter comprising a braking cam, said braking cam having at least one braking cam lobe, and said at least one braking cam lobe actuating said braking piston for opening the braking exhaust valve when said braking piston is in said operative position.

4. The apparatus of claim 1, wherein said actuator further comprises a spring for biasing said dedicated valve lifter away from said braking piston.

5. The apparatus of claim 1, wherein said actuator further comprises a braking valve lifter integrated into said exhaust valve lifter, said braking valve lifter having at least one braking cam lobe integrated into said exhaust cam with said exhaust cam lobe, said exhaust cam lobe being enlarged for accommodating the integration of said at least one braking cam lobe, and said at least one braking cam lobe actuating said braking piston for opening the braking exhaust valve when said braking piston is in said operative position.

6. The apparatus of claim 1, wherein said actuator further comprises a dedicated braking load supporting system, said dedicated braking load supporting system comprising a housing installed on the engine, and said housing acting on said braking piston for holding open the braking exhaust valve when said braking piston is in said operative position.

7. The apparatus of claim 1, wherein said actuator further comprises a braking load supporting system integrated into said exhaust valve lifter, and said braking load supporting system acting on said braking piston for holding open the braking exhaust valve when said braking piston is in said operative position.

8. The apparatus of claim 1, further comprising a universal pad for an improved load transmitting during said engine braking operation.

9. The apparatus of claim 1, further comprising a valve lash adjusting device integrated into said actuator for setting a lash or gap between said actuator and the braking exhaust valve.

10. The apparatus of claims 1 or 5, further comprising an engine brake reset device for modifying the valve lift profile produced by said enlarged exhaust cam lobe during the engine braking operation, and said reset device comprising a reset piston and at least one reset flow passage.

11. The apparatus of claim 1, further comprising a spring for preventing the exhaust valve train components from no-following.

12. The apparatus of claim 1, wherein said controller comprises an electro-hydro-mechanical system, said electro-hydro-mechanical system comprising a solenoid valve for supplying and cutting off a fluid flow to said braking piston; and said fluid flow controlling the motion of said braking piston between the inoperative position and the operative position.

13. The apparatus of claim 1, wherein said controller further comprises a flow drain for draining the fluid flow under said braking piston, and said flow drain comprising a bleeding orifice or a flow draining passage.

14. A method of modifying engine valve lift in an internal combustion engine to produce an auxiliary engine valve event that is different from a normal engine operation, the engine having an engine valve train comprising two engine valves, a valve bridge and an engine valve lifter for cyclically opening and closing the two engine valves, said method comprising the steps of: (a) providing an actuator comprising a hydraulic system integrated into said exhaust valve train, said hydraulic system comprising a hydraulic piston slidably disposed in said valve bridge between an inoperative position and an operative position, in said inoperative position, said hydraulic piston being retracted and said actuator being disengaged from said normal engine operation, and in said operative position, said hydraulic piston being extended and said actuator opening one of the two engine valves for said auxiliary engine valve event; (b) providing a controller for moving said hydraulic piston with a fluid flow; (c) turning on said controller and supplying the fluid flow to said hydraulic piston; (d) moving said hydraulic piston from said inoperative position to said operative position; (e) acting on said hydraulic piston by said actuator; and (f) opening one of the two engine valves for said auxiliary engine valve event.

15. The method of claim 14, further comprising the steps of: (a) providing an actuator further comprising a dedicated valve lifter, said dedicated valve lifter comprising a dedicated cam, and said dedicated cam having at least one dedicated cam lobe; (b) turning on said controller and supplying the fluid flow to said hydraulic piston; (c) moving said hydraulic piston from said inoperative position to said operative position; (d) actuating said hydraulic piston by the at least one dedicated cam lobe of said dedicated valve lifter; and (e) opening one of the two engine valves for said auxiliary engine valve event.

16. The method of claim 14, further comprising the steps of: (a) providing an actuator further comprising a housing installed on the engine; (b) turning on said controller and supplying the fluid flow to said hydraulic27 piston; (c) opening the two engine valves by said engine valve lifter and said valve bridge; (d) moving said hydraulic piston from said inoperative position to said operative position; (e) acting on said hydraulic piston by said housing; and (f) blocking one of the two opened engine valves from closing and holding it open for said auxiliary engine valve event.

17. The method of claim 14, further comprising the steps of: (a) providing a controller further comprising a flow drain having a bleeding orifice or a flow draining passage; (b) turning off said controller and cutting off the fluid flow to said hydraulic piston; (c) opening said bleeding orifice or flow draining passage; (d) draining the fluid under said hydraulic piston through said flow drain; (e) moving said hydraulic piston to the inoperative position; and (f) disengaging said actuator from said normal engine operation and turning off said auxiliary engine valve event.

18. A method of modifying engine valve lift in an internal combustion engine to produce an auxiliary engine valve event that is different from a normal engine operation, the engine including engine valve train including two engine valves, a valve bridge and an engine valve lifter for cyclically opening and closing the two engine valves, said method comprising the steps of: (a) providing an actuator integrated into said exhaust valve train, said actuator comprising a hydraulic system and a valve lash adjusting device, said hydraulic system comprising a hydraulic piston slidably disposed in said valve bridge, and said valve lash adjusting device being integrated into said engine valve lifter; (b) providing a controller for moving said hydraulic piston in said valve bridge between an inoperative position and an operative position with a fluid flow; (c) turning on said controller and supplying the fluid flow to said hydraulic piston; (d) moving said hydraulic piston from said inoperative position to said operative position; (e) acting on said hydraulic piston by said actuator through said valve lash adjusting device; and (f) opening one of the two engine valves for said auxiliary engine valve event.

19. The method of claim 18, further comprising the steps of: (a) providing an actuator further comprising at least one auxiliary cam lobe integrated into the normal cam with the normal cam lobe of said engine valve lifter, said normal cam lobe being enlarged to accommodate the integration of said at least one auxiliary cam lobe; (b) providing a reset device for modifying the valve lift profile produced by the enlarged normal cam lobe, said reset device comprising a reset piston and at least one reset flow passage; (c) moving said reset piston and uncovering said reset flow passage; (d) draining out the fluid under said hydraulic piston and moving said hydraulic piston from said operative position to said inoperative position; (e) disengaging said an actuator from the engine valves; (f) opening and then closing both of the two engine valves by the enlarged normal cam lobe through said engine valve lifter; (i) moving said reset piston and blocking said reset flow passage; (j) refilling said hydraulic piston and moving said hydraulic piston from said inoperative position back to said operative position; (k) actuating said hydraulic piston by the at least one auxiliary cam lobe through said valve lash adjusting device; and (1) opening one of the two engine valves for said auxiliary engine valve event.

20. The method of claim 19, further comprising the steps of: (a) moving said engine valve lifter down by the enlarged normal cam lobe; (b) blocking the fluid flow from said a controller to said hydraulic piston; (c) moving said valve bridge down by said engine valve lifter; (d) opening said reset flow passage and draining out the fluid under said hydraulic piston; (e) moving said hydraulic piston from said operative position to said inoperative position; (f) disengaging said actuator from the engine valves; (g) opening and then closing both of the two engine valves by the enlarged normal cam lobe through said engine valve lifter; (h) moving said engine valve lifter up and re-opening the fluid flow from said controller to said hydraulic piston; (i) refilling said hydraulic piston and moving said hydraulic piston from said inoperative position back to said operative position; (j) blocking the reset flow passage and actuating said hydraulic piston by the at least one auxiliary cam lobe through said valve lash adjusting device; and (k) opening the engine valve for said auxiliary engine valve event.

* * * * *